United States Patent [19]

Kondo

[11] 4,436,138

[45] Mar. 13, 1984

[54] METHOD OF AND APPARATUS FOR RECLAIMING MOLDING SAND

[75] Inventor: Toshio Kondo, Yokohama, Japan

[73] Assignee: Nippon Chuzo Kabushiki Kaisha, Kanagawa, Japan

[21] Appl. No.: 351,327

[22] Filed: Feb. 22, 1982

Related U.S. Application Data

[63] Continuation-in-part of Ser. No. 171,404, Jul. 23, 1980, abandoned.

[51] Int. Cl.[3] ..... B02C 19/12

[52] U.S. Cl. ..... 164/5; 164/412; 241/275; 241/DIG. 10

[58] Field of Search ..... 164/5, 412; 241/DIG. 10, 275

[56] References Cited

U.S. PATENT DOCUMENTS

| | | | |
|---|---|---|---|
| 2,707,314 | 5/1955 | Horth | 241/DIG. 10 |
| 3,175,686 | 3/1965 | Rieth | 164/5 X |
| 3,834,631 | 9/1974 | King | 241/275 X |
| 3,970,257 | 7/1976 | MacDonald et al. | 241/275 |

FOREIGN PATENT DOCUMENTS

| | | | |
|---|---|---|---|
| 2408981 | 9/1975 | Fed. Rep. of Germany | 164/5 |
| 749539 | 7/1980 | U.S.S.R. | 164/5 |

*Primary Examiner*—Gus T. Hampilos
*Assistant Examiner*—J. Reed Batten, Jr.
*Attorney, Agent, or Firm*—Michael N. Meller

[57] ABSTRACT

A reclamation apparatus comprising a centrifugal apparatus for removing impurities from sand by abrasion and entrainment. The apparatus is used to reproduce old molding sand so as to be useable again in making molds and, comprises a cylindrical body including an old sand feed hopper and a dust attraction opening in its upper part, an open-top rotary drum in its central part and a reclaimed sand discharge opening in its lower part. The old sand supplied through the feed hopper is distributed uniformly along the peripheral portion of the bottom plate of the rotary drum by means of a distributor, and the rotary drum is rotated at a high speed to cause a shearing phenomenon in the layer of sand and cause the sand to scatter over the peripheral wall of the drum. A scattered sand retaining and collision rack formed into a C-shape is provided in the cylindrical body so as to enclose the top of the outer periphery of the drum at a predetermined space or distance therefrom, whereby the scattered sand is partially caused to flow downward through the rack and the space between the drum and the rack while the other part of the sand is caused to flow over the top of the rack causing the sand to fall peripherally around the rack. The fine particles divided and included in the sand are blown off by a jet of air and discharged through the dust attraction opening, thus discharging the reclaimed sand through the lower discharge opening.

4 Claims, 1 Drawing Figure

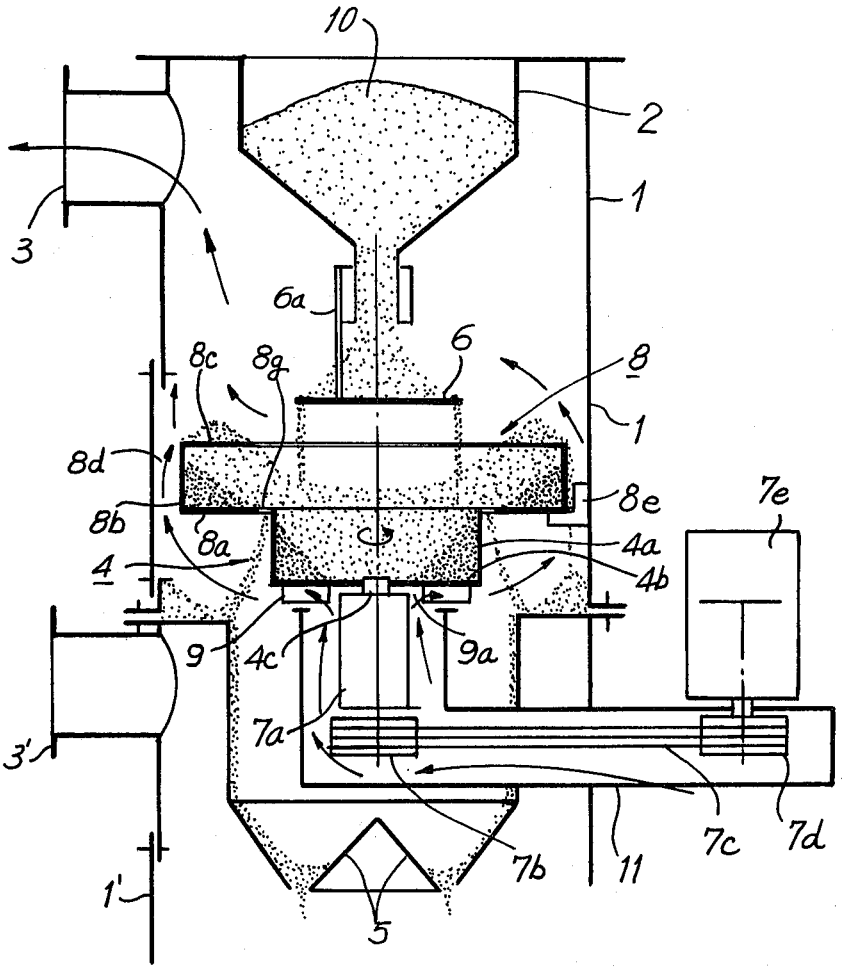
10
2
1
3
6a
6
8c
8g
8
1
8d
8e
7e
8b
8a
4a
4
4b
9
4c
9a
7a
3'
7c
7d
7b
11
1'
5

METHOD OF AND APPARATUS FOR RECLAIMING MOLDING SAND

CROSS-REFERENCE TO RELATED APPLICATION

This application is a continuation-in-part of U.S. Ser. No. 171,404 filed July 23, 1980 and now abandoned.

BACKGROUND OF THE INVENTION

The present invention relates to a reclamation apparatus for repeatedly using old molding sand used in making molds.

Molding sand is used repeatedly from the standpoint of economy, etc. However, molding sand which has been used previously includes hardened and burned binding material, facing agent, etc., as well as finely divided sand caused by thermal shock and the like and to reuse such sand, it is necessary to remove these inclusions.

Molding sand reclamation methods which have heretofore been used mostly consist of directing a jet of air against old sand or mechanically turning old sand in a stream of air and then attracting the air so as to remove the dust or finely divided particles by means of a cyclone or the like. However, the known apparatus for performing the methods are disadvantageous in that their principal parts are subject to heavy wear due to sand, thus requiring frequent replacement of their component parts.

DESCRIPTION OF THE PRIOR ART

In German Published Patent Application No. 24 08 981 there is shown an apparatus for reclaiming molding sand, however, the driven rotary drum contained therein is not constructed so as to provide the appropriate shearing action for reclaiming old molding sand.

U.S. Pat. No. 3,834,631 to King shows comminuting apparatus employing friction generated by a bowl-shaped rotating element. This apparatus fails, however, in providing the type and necessary interlayer friction and shearing forces for the efficient reclamation of such old molding sand.

U.S. Pat. No. 3,175,686 to Rieth teaches a method and apparatus for cooling and reconditioning molding sand, but does not disclose in any manner the self cleansing and shearing of sand particles rubbing on one another.

SUMMARY OF THE INVENTION

It is the principal purpose of the present invention to provide an apparatus the component parts of which are practically free from wear due to sand and which is capable of economically and smoothly reclaiming old molding sand.

In accordance with the present invention, there is provided a molding sand reclamation apparatus comprising a cylindrical body having an old sand feed hopper and a dust attraction opening in its upper part; an open-top rotary drum in its central part and a reclaimed sand discharge opening in its lower part; a distributor connected to the feed hopper so as to uniformly distribute the supplied old sand along the peripheral portion of the rotary drum bottom plate, the rotary drum being constructed such that the old sand fed into the rotary drum is caused to scatter over the peripheral wall of the rotary drum by its rotation, a scattered old sand retaining and collision rack means mounted in the cylindrical body so as to enclose the top of the outer periphery of the drum and to be apart by a predetermined space from the top edge portion of the drum open top and the cylindrical body, respectively, a fine particle and dust blow-off fan attached to the lower side of the rotary drum, and a suction pipe having its one end connected to the central suction port of the fan and the other end located outside the cylindrical body. The rack means is in the form of an annular rack having a C-shaped section and having its lower flange arranged substantially flush with the upper edge portion of the rotary drum open top, and the rack is supported on the cylindrical body with the flange directed inwardly to provide some space between the rack and the cylindrical body. The length of the space between the lower flange end of the annular rack and the rotary drum is adjustable, and the fan is integrally attached to the lower side of the rotary drum such that its central axis is in alignment with that of the rotary drum.

BRIEF DESCRIPTION OF THE DRAWING

The FIGURE shows a schematic longitudinal sectional view showing an embodiment of the apparatus in accordance with the invention.

DESCRIPTION OF THE PREFERRED EMBODIMENTS

Referring first to the FIGURE, there is illustrated an apparatus according to the present invention comprising a cylindrical body 1 having in its upper part an old sand hopper 2 forming a feed opening for old sand 10 and a dust attraction opening 3, a rotary drum 4, in its central part, and a reclaimed sand discharge opening 5 in its lower part.

The apparatus also comprises a distributor 6 attached to the hopper 2 such that the supplied old sand is uniformly supplied along the peripheral portion of the bottom plate of the rotary drum 4. Numeral **6*a* designates a support member for attaching the distributor 6 to the hopper 2**.

One side of the rotary drum 4 is opened and it is arranged at the center part of the cylindrical body 1 in such a manner that its open side is turned upside. Numeral **4*a* designates a drum peripheral wall of a suitable height, and 4*b* a drum bottom plate. A rotary shaft 4*c* attached at the central axis of the rotary drum 4, is supported on the cylindrical body 1 by a bearing case 7*a*, and a V-pulley 7*b* is mounted on the lower end of the rotary shaft 4*c* to rotate to it at high speed by a motor 7*e* through a V-pulley 7*d* and a V-belt 7*c*. The old sand 10 fed into the rotary drum 4 is scattered by its rotation over the peripheral wall 4*a***.

An annular rack 8 having a C-shaped section is supported on the cylindrical body 1 by supports **8*e* in such a manner that its lower flange 8*a* is placed substantially flush with the open top upper edge portion or the upper end of the peripheral wall 4*a* of the rotary drum 4 and the flange 8*a* is directed inwardly to provide some space 8*d* between the rack 8 and the cylindrical body 1. Numeral 8*b* designates a web portion, and 8*c* an upper flange. The forward end of the lower flange 8*a* is extended inwardly to a predetermined length so that the old sand which is scattered by the centrifugal force from within the rotary drum 4 is retained on the lower flange 8*a* and thus prevented from falling downward directly, and a space 8*g* is defined between the forward end of the lower flange 8*a*** and the upper end of the peripheral wall 4*a* facing the former. The old sand particles are scattered by the centrifugal force while rubbing against one another so that the scattered sand particles collide with the sand layer on the web portion 8*b* and the lower flange 8*a* of the annular rack 8 and thus the sand falls through the space 8*g* while being subjected to friction. The length of the space 8*g* is adjusted in accordance with the amount of sand supplied by distributor 6. The sand remains in the area defined by the rotary drum 4 and the annular rack 8 so that the sand overflows the upper flange 8*c* of the annular rack 8 and the sand starts to fall through the space 8*d*. Eventually the point is reached where the amount of sand falling through the spaces 8*d* and 8*g* becomes equal to the amount of sand supplied and thereafter the amount of remaining sand is maintained constant.

While the amount of retained sand is constant, the retention time can be controlled by adjusting the amount of sand supplied. This feature is not shown by any prior art apparatus known to applicant. The relationship of this retention time is as follows:

$$T=Q\times k/C$$

where T=retention time (sec), Q=retained amount (kg) C=rate of supply (kg/hr), and k=3600 sec/hr.

EXAMPLE 1

Q=10 kg (actual measurement), C=5000 kg/hr:
$T_1=10\times 3600/5000=7.2$ sec

EXAMPLE 2

Q=10 kg C=2500 kg/hr:
$T_2=10\times 3600/2500=14.4$ sec

If the value of C is reduced by one half, the resulting value of T would be two times greater. Thus, if the value of C is reduced to 2500 kg/hr, it is possible to obtain about the same result as if the reclaiming operation were effected twice at 5000 kg/hr.

From the foregoing, it will be noted that the present invention has features that sand is retained in both the drum 4 and the rack 8 and that during the interval the retained sand is moved slowly in an eddy and subjected to uniform friction or rubbing. This friction is an "interlayer friction" between the layers of the lining sand and the retained sand and moreover the weight of the retained sand has the effect of intensifying the friction between the sand layers.

Attached integrally to the lower side of the rotary drum 4 is a fan 9 whose central axis is aligned with that of the rotary drum 4. A suction pipe 11 is disposed so that its forward end is connected with a central suction port 9*a* of the fan 9 and its rear end portion is extended to the outside of the cylindrical body 1. While, in the illustrated embodiment, the suction pipe 11 is disposed by way of example so as to enclose the bearing case 7*a*, the V-pulley 7*b*, the V-belt 7*c* and the V-pulley 7*d*, this arrangement is preferred from the structural point of view for the purpose of preventing any contact between the moving parts and the suction pipe. Although the suction port of the suction pipe 11 is not shown in the FIGURE, it may be comprised for example of the operating window of the V-pulley 7*d* or it may be suitably provided separately.

The operating principle of the apparatus according to the invention will now be described. The old sand is supplied by the distributor 6 in such a manner that the old sand is uniformly fed in the form of a cylindrical curtain toward the sand stuck to the inner wall of the rotary drum 4 by the centrifugal force. The falling sand cannot follow the high speed rotation of the rotary drum 4 so that a shearing phenomenon is caused in the sand layer and this results in a frictional action between the surfaces of sand particles thus rubbing off the adhering matter. The angle at which the sand is stuck to the rotary drum 4 is maintained substantially the same with the ordinary angle of rest so that the continuously supplied sand is moved toward the upper end along the angle of rest and the sand is circumferentially accelerated while being subjected to the previously mentioned shearing action. As a result, the sand overflowing from the upper end is scattered in all directions at high velocity under the effect of a strong centrifugal force. Since the annular rack 8 is provided to surround the rotary drum 4 so that the previously scattered sand is retained on the annular rack, the sand scattered by the rotary drum 4 strikes against it at high velocity and the adhering matter is separated further. The sand overflowing from the annular rack 8 and falling through the space 8*g* is circumferentially blown off by the jet of air from the fan 9 which is integral with the rotary drum 4, so that the included finely divided particles are forcibly separated from the sand and discharged through the dust attraction opening 3 and the reclaimed sand is discharged from the discharge opening 5. The dust attraction opening 3 is usually connected to a dust collector.

Since the rotary drum 4 is rotated continuously, the drum inner wall is formed with a fixed layer of sand stuck thereto by the centrifugal force as shown by the small scattered dots in the FIGURE. However, the sand accumulated over the fixed sand layer does not rotate with the rotary drum 4 but just stays on the fixed layer. As a result, there exists a boundary surface between the top sand and the fixed sand layer which rotates along with the rotary drum 4, and consequently friction occurs at the boundary surface under the weight of the accumulated sand, thus exerting a powerful separating effect on the adhering matter. As if involved in a swirl, the accumulated sand falls through the central portion of the annular rack, moves upward along the fixed sand layer on the rotary drum, moves upward further along the fixed sand layer on the annular rack and then flows over the upper flange 8*c* or alternatively the sand overflows after repeatedly circulating within the rotary drum 4 and the annular rack 8. Because of this movement of the sand, friction occurs between the individual particles of sand and the adhering matter is efficiently scraped off the sand. While this interparticle friction is small between the individual particles due to their mass being so small, the friction between the sand layers is strong since it takes place under the load of the accumulated sand.

The fan 9 serves the function of attracting the cold air through around the bearings of the rotary shaft 4*c* in addition to the blowing of the dust and thus it serves the purpose of cooling the bearings which tend to be overheated due to the processing of hot sand.

While the apparatus of the invention constructed as described above is used as a single-stage unit, it is possible to use several units of the apparatus by arranging them one on top of another in stages as occasion demands. The FIGURE shows two units of the apparatus which are arranged one on top of another in a two-stage fashion and only a cylindrical body 1′ and a dust attraction opening 3′ of the second unit are shown partly. The quality of reclaimed sand can be adjusted as desired by suitably adjusting the amount of old sand to be processed and suitably selecting the number of processing stages and the number of revolutions.

By processing the shell old sand having an ignition loss of 1.7% by the apparatus of one embodiment arranged in 5 stages, it was possible to reclaim sand having an ignition loss of 0.83% or a removing rate of 51%. Also, in the case of the carbon dioxide process old sand, the alkali content of the reclaimed sand was 3.32 ml as compared with the original content of 7.01 ml or the removing rate was 53%.

Reclamation of the old furan resin bonded sand by the apparatus showed that the ignition loss of 1.97% was changed to 0.77% (the removing rate of 61%), the molding strength and working time of the reclaimed sand were increased over those of new sand, and the recovery percentage was 92%.

In accordance with the apparatus of this invention, while it is conceivable to remove the upper flange of the annular rack having a C-shaped section to convert the same into annular rack having an L-shaped section, in the latter case the retention time of sand or the time during which the sand is subjected to friction decreases and it is necessary to increase the height of the vertical portions corresponding to the flange. Thus, the annular rack having a C-shaped section is preferred.

The apparatus according to the invention has the following advantages. Since the reclaiming operation is accomplished by means of friction and collision between the sand particles, the wear of the apparatus is reduced very greatly. Further, since there is practically no wear of the apparatus, the labor required for maintenance and inspection, such as, replacement of the compartment parts is reduced. Due to the use of friction and collision between sand particles, the crushing of sand is very small. Due to its simplified construction, the apparatus of this invention is inexpensive to manufacture. Since the apparatus of this invention is made more compact, a plurality of units of the apparatus can be arranged one on top of the other in a multi-stage fashion. Further, since the bearings are cooled by cold air, it is possible to process hot sand.

This invention has been described with respect to a preferred embodiment which is considered the inventor's best mode. However, it will be understood that modifications and variations may be effected without departing from the scope of the novel concepts of the present invention.

We claim:

1. A molding sand reclamation apparatus comprising:

(a) a cylindrical housing having an opening for dust exhaustion in an upper part thereof;

(b) a feed opening for supplying unreclaimed sand, located in the upper part of said cylindrical housing;

(c) a rotary drum positioned concentrically below a distributor for receiving distributed unreclaimed sand and having a cylindrical wall, a flat base, and no top such that said distributed unreclaimed sand is centrifugally scattered over the top of said cylindrical wall when said rotary drum rotates;

(d) a distributor rigidly fixed to said feed opening so dimensioned as to enable distributing said unreclaimed sand fed by said feed opening within the perimeter of the rotary drum, said distributed unreclaimed sand falling in a cylindrical curtain from the outer periphery of said distributor;

(e) an annular C-shaped rack means, having a lower flange, a cylindrical wall, and an upper flange, concentrically mounted above said rotary drum for receiving said scattered unreclaimed sand and retaining said sand in place, said lower flange of said rack means being separated by a first predetermined distance from the top of said cylindrical wall of said rotary drum, and said cylindrical wall of said rack means being separated by a second predetermined distance from said cylindrical housing;

(f) a fan attached integrally to the lower surface of said rotary drum, such that the axis of rotation of said fan and the axis of rotation of said rotary drum are in alignment;

(g) a suction pipe having one end thereof connected to a central suction port of said fan and the other end thereof which communicates with the outside of said cylindrical housing; and (h) a discharge opening for discharging reclaimed sand, located in the lower part of said cylindrical housing, wherein said first predetermined distance is adjustable by adjusting said lower flange of said rack means so that the amount of distributed unreclaimed sand escaping through said first predetermined distance per unit time is less than the amount of unreclaimed sand being supplied through said feed opening per unit time, thereby ensuring that scattered unreclaimed sand overflows the outer periphery of said rack means.

2. An apparatus according to claim 1, wherein said rotary drum and said rack means are configured and dimensioned so as to induce interlayer friction and shearing forces in said unreclaimed sand, such that a first amount of said unreclaimed sand is held stationary relative to said rotary drum by means of the centrifugal force produced when said rotary drum rotates, a second amount of said unreclaimed sand is held stationary relative to said rack means, and a portion of said unreclaimed sand is scattered over said first and second amounts and then overflows the outer periphery of said rack means.

3. A process for reclaiming molding sand comprising the steps of:

(a) feeding unreclaimed sand through a feed opening onto a cylindrical distributor;

(b) allowing the fed sand to overflow the periphery of said distributor and to fall in a cylindrical curtain of a smaller diameter into a rotating rotary drum having a larger diameter;

(c) scattering sand centrifugally by rotation of said rotary drum so that the scattered sand rubs against stationary sand pressed by centrifugal force against the cylindrical wall of said rotary drum, thereby producing shearing forces between the scattered and stationary layers of sand;

(d) allowing the scattered sand to overflow the periphery of said rotary drum and to escape through a space defined by the top of the cylindrical wall of said rotary drum and the lower flange of an annular C-shaped rack means, such that the rate of escape is less than the rate of supply through said feed opening;

(e) holding some of the scattered sand stationary by means of said rack means and allowing the scattered sand which did not escape through said space to scatter further as a result of the centrifugal force produced by said rotating rotary drum, thereby producing additional shearing forces between the further scattered and the stationary layers of sand; and (f) overflowing the further scattered sand over the periphery of said rack means.

4. The process according to claim 3, wherein the sand is retained in the space defined by said rotary drum and said rack means for a constant period of time, defined as the retention time, said retention time being adjustable by adjusting the rate of supply of unreclaimed sand in accordance with the formula $T=Q\times(k/C)$, where T is said retention time in seconds, Q is the amount of sand retained at a predetermined moment in kilograms, C is said rate of supply in kilograms per hour, and k is a constant equal to 3600 seconds per hour.

* * * * *